US006607075B1

(12) United States Patent
Galvani

(10) Patent No.: US 6,607,075 B1
(45) Date of Patent: Aug. 19, 2003

(54) COIN COLLECTING STORAGE SYSTEM

(76) Inventor: Warren G. Galvani, 4151 E. Jordan # 10, Mt. Pleasant, MI (US) 48858

( * ) Notice: Subject to any disclaimer, the term of this patent is extended or adjusted under 35 U.S.C. 154(b) by 0 days.

(21) Appl. No.: 10/006,872

(22) Filed: Oct. 26, 2001

(51) Int. Cl.[7] ..... A45C 1/00
(52) U.S. Cl. ..... 206/84; 206/459.5
(58) Field of Search ..... 206/0.8, 0.81, 206/0.82, 0.83, 0.84, 480, 490, 459.5; 434/130, 150–153

(56) References Cited

U.S. PATENT DOCUMENTS 1,719,962 A * 7/1929 Beistle ..... 206/0.8
2,318,850 A 5/1943 Grant
2,428,498 A * 10/1947 McWilliams ..... 206/0.83
2,449,204 A 9/1948 Curtis
2,521,792 A 9/1950 Hollander
3,064,805 A * 11/1962 Bains ..... 206/0.83
3,145,833 A * 8/1964 Muller ..... 206/0.83
3,217,866 A * 11/1965 Phelps ..... 206/0.83
4,058,916 A * 11/1977 Whyatt ..... 206/0.84
4,929,865 A 5/1990 Blum
D331,421 S 12/1992 Ross
5,191,972 A 3/1993 Helzer et al.
5,595,797 A 1/1997 Miller
6,330,942 B1 * 12/2001 Raymond ..... 206/0.84

* cited by examiner

*Primary Examiner*—Luan K. Bui

(57) ABSTRACT

A coin collecting storage system includes a plurality of panels. Each of the panels has a front side, a left portion, a right portion and a central portion. The central portion has a plurality of sets of depressions therein. Each of the sets of depressions is associated with a set of coins from one minting city. Each of the depressions on the panel is associated with a year of minting. Wherein the depressions are not positioned in the set of depressions for coins not minted such that only a group of coins minted in one year may be stored in an associated one of the panels according to minting city. Each of the right portions has year indicia thereon corresponding to the year of minting. Each of the left portions has city name indicia thereon aligned with a corresponding set of depressions.

5 Claims, 4 Drawing Sheets

COIN COLLECTING STORAGE SYSTEM

BACKGROUND OF THE INVENTION

1. Field of the Invention

The present invention relates to coin collecting storage systems and more particularly pertains to a new coin collecting storage system for allowing a user to easily store, organize, and reference coins from a particular year and form a particular mint.

2. Description of the Prior Art

The use of coin collecting storage systems is known in the prior art. U.S. Pat. No. 2,521,792 describes a system for displaying coins, medals and other objects. Another type of coin collecting storage systems is U.S. Pat. No. 2,449,204 having a display page or holder for coins.

While these devices fulfill their respective, particular objectives and requirements, the need remains for a system that has certain improved features that provide the user with pertinent information about coins from specific mints, years, and types of coins, and indication for when a coin is not available from a particular mint year.

SUMMARY OF THE INVENTION

The present invention meets the needs presented above by having pages that have spaces only for coins that were produced by a particular mint in a particular year.

Still yet another object of the present invention is to provide a new coin collecting storage system that would offer a collector the opportunity to store a large number of coins in an organized and attractive fashion.

Even still another object of the present invention is to provide a new coin collecting storage system that would be easy to use and would also educate the user about coin facts such as history, minting processes, and coin design.

To this end, the present invention generally comprises a plurality of panels. Each of the panels has a front side, a left portion, a right portion and a central portion. The central portion has a plurality of sets of depressions therein. Each of the sets is aligned along generally parallel lines that extend from left to right. Each of the sets of depressions is associated with a set of coins from one minting city. Each of the sets of coins generally includes a penny, a nickel, a dime, a quarter, a half-dollar and a dollar. Each of the depressions on the panel is associated with a year of minting. Wherein the depressions are not positioned in the set of depressions for coins not minted such that only a group of coins minted in one year may be stored an associated one of the panels according to minting city. Each of the right portions has year indicia thereon corresponding to the year of minting. Each of the left portions has city name indicia thereon aligned with a corresponding set of depressions, wherein each of the panels corresponds to a different year.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
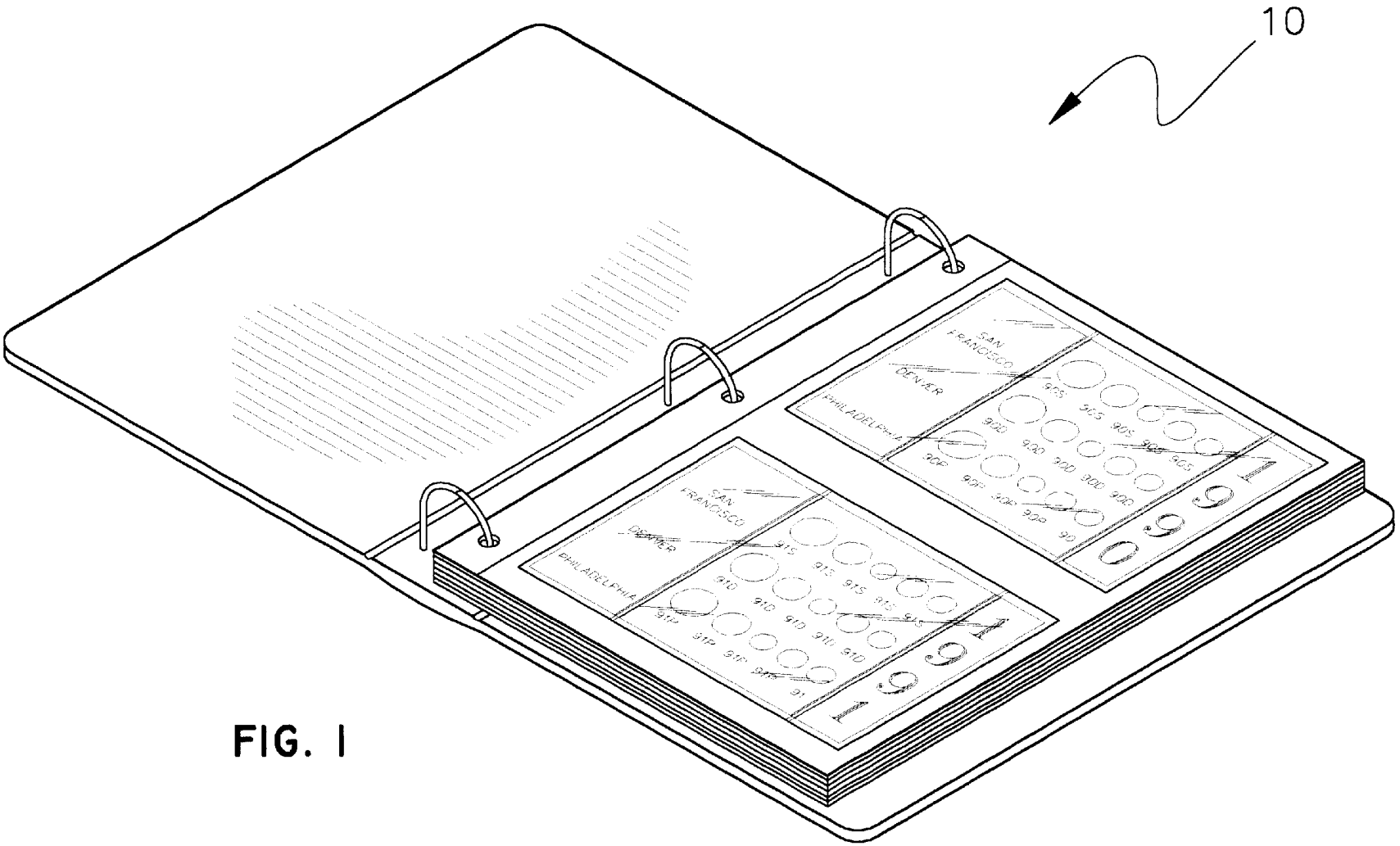
FIG. 1 is a perspective view of a new coin collecting storage system according to the present invention.
Figure 2:
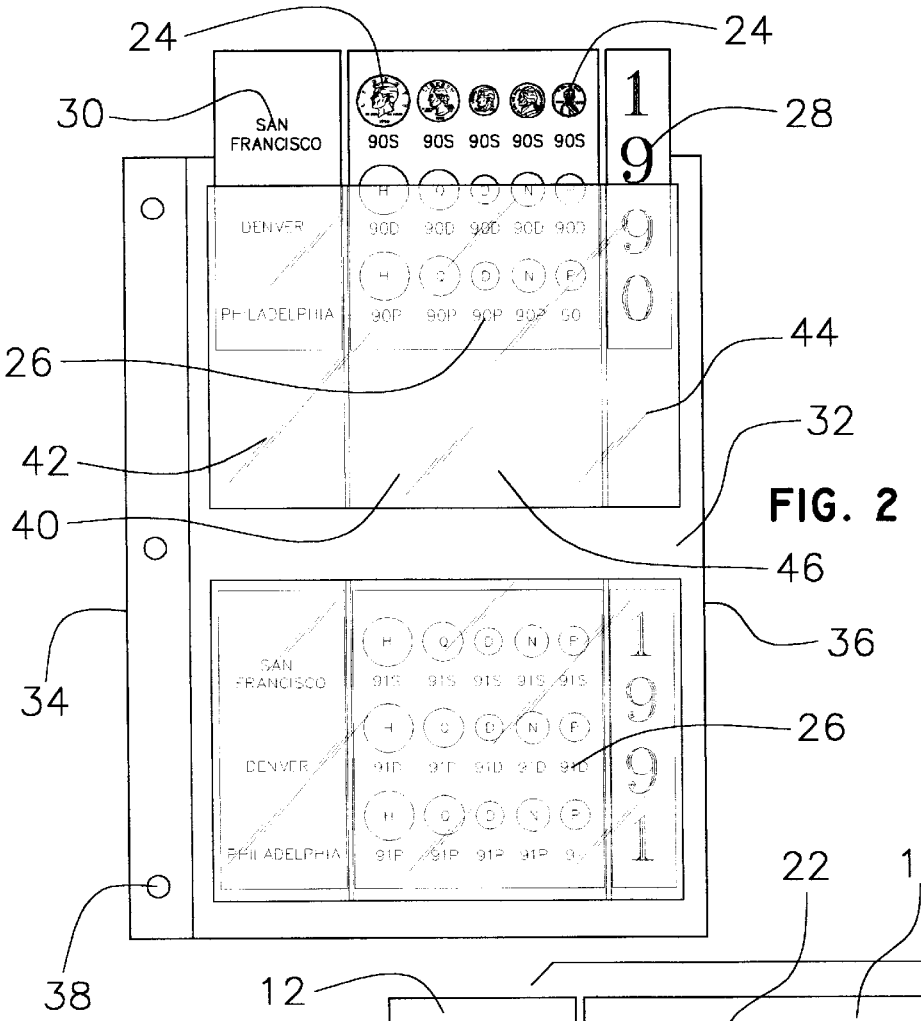
FIG. 2 is a front view of the present invention.
Figure 3:
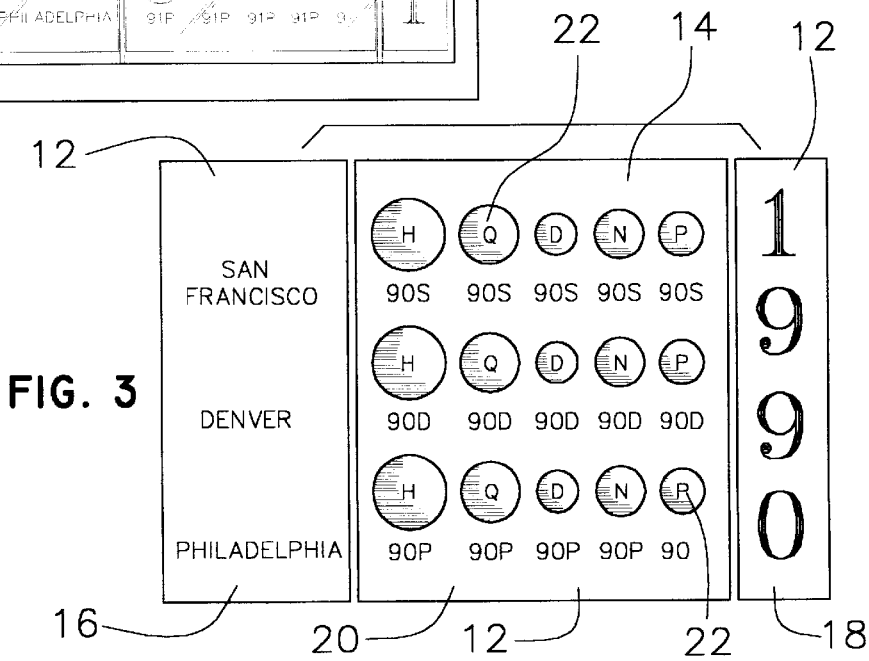
FIG. 3 is a front view of the present invention.
Figure 4:
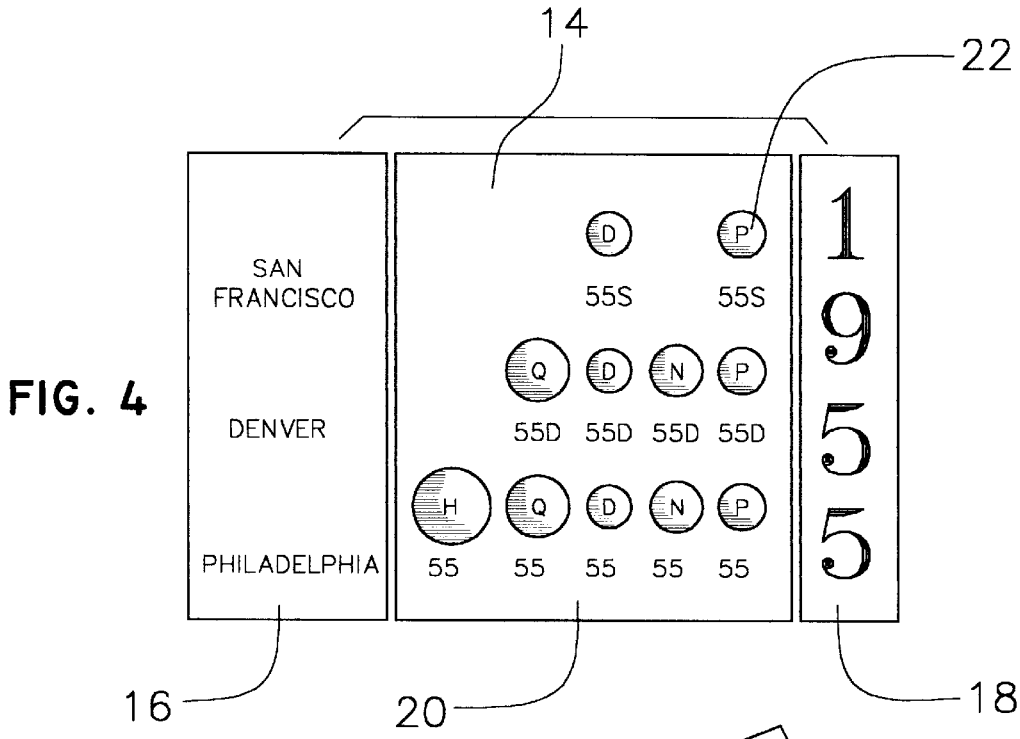
FIG. 4 is a front view of the present invention.
Figure 5:
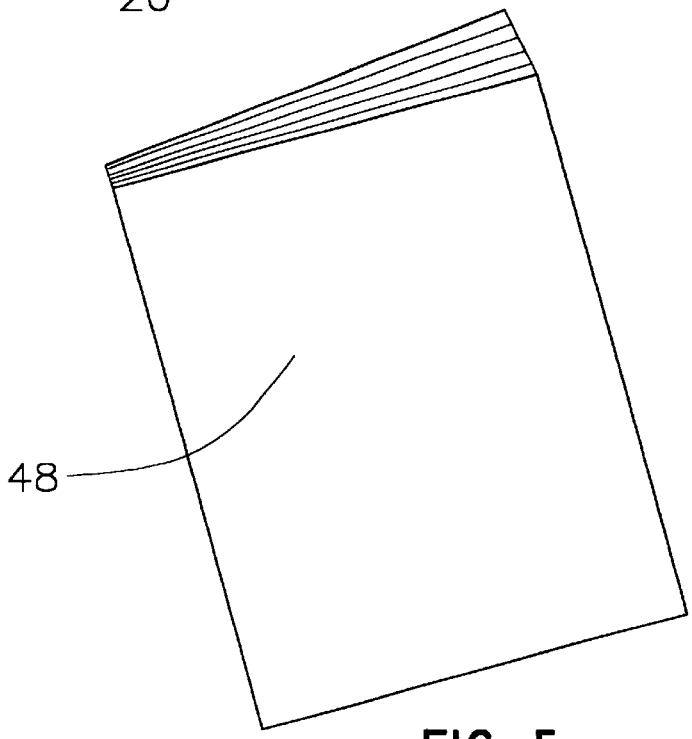
FIG. 5 is a perspective view of the present invention.
Figure 6:
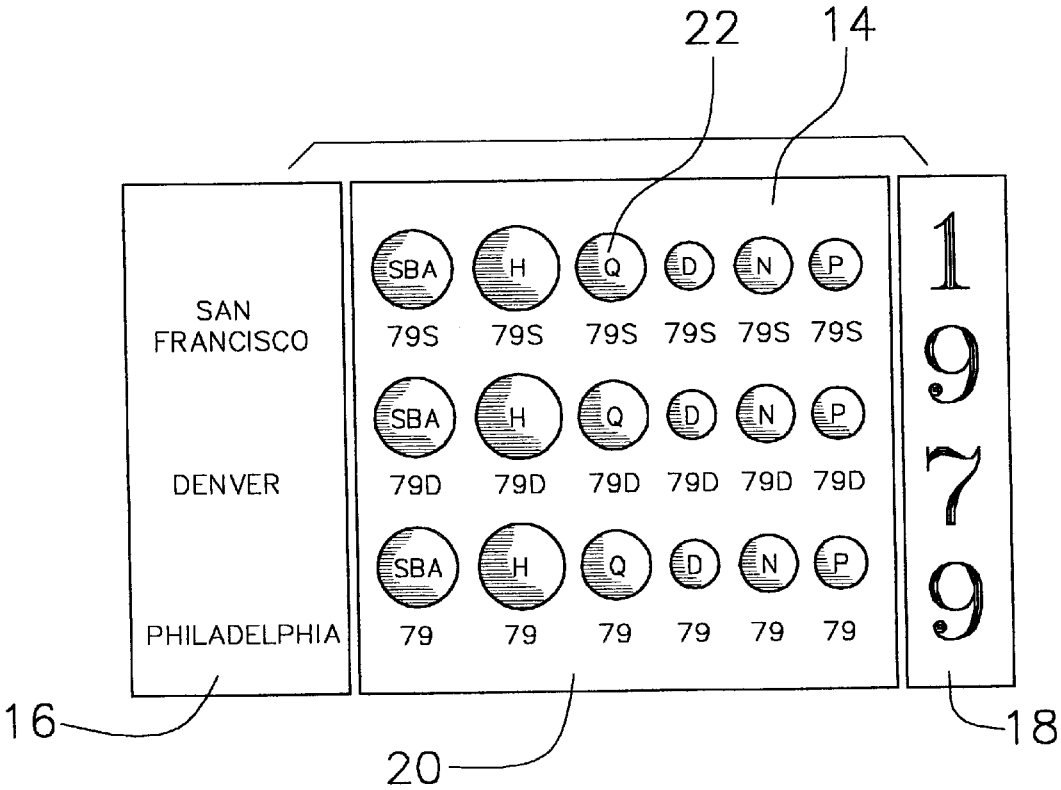
FIG. 6 is a front view of the present invention including depressions for dollar coins.

With reference now to the drawings, and in particular to FIGS. 1 through 6 thereof, a new coin collecting storage system embodying the principles and concepts of the present invention and generally designated by the reference numeral 10 will be described.

As best illustrated in FIGS. 1 through 6, the coin collecting storage system 10 generally comprises a plurality of panels 12. Each of the panels 12 has a front side 14 that has a left portion 16, a right portion 18 and a central portion 20. The central portion 20 has a plurality of sets of depressions 22 therein. Each of the sets is aligned along generally parallel lines that extend from left to right. Each of the sets of depressions 22 is associated with a set of U.S. coins 24 from one minting city. Each of the sets of coins generally includes a penny, a nickel, a dime, a quarter, a half-dollar and a dollar. Each of the depressions 22 on the panel 12 is associated with a year of minting. Wherein the depressions 22 are not positioned in the set of depressions 22 for coins 21 not minted such that only a group of coins 24 minted in one year may be stored an associated one of the panels according to minting city. Each of the depressions 22 has year and minting mark indicia 26 positioned adjacent thereto. Wherein the minting mark indicia 26 are not indicated if the associated coin 24 does not have a mint mark thereon. Each of the right portions 18 has year indicia 28 thereon that correspond to the year of minting. Each of the left portions 16 has city name indicia 30 thereon aligned with a corresponding set of depressions 22. The left 16 and right 18 portions are severed from the middle portion, wherein each of the panels 12 corresponds to a different year.

A plurality of binding sheets 32, each is generally planar and has a generally rectangular shape with a left edge 34 and a right edge 36. Each of the sheets 32 has a plurality of apertures 38 therein positioned generally adjacent to the left edge 34. A pair of sets of pockets 40 is positioned on one side of the sheets 32. Each of the sets includes three pockets 40. Wherein there is defined a left pocket 42, a right pocket 44 and a center pocket 46. Each of the portions of the panels 12 is removably extendable into one of a corresponding one of the pockets 40.

A binder 48 is for releasably holding a plurality of sheets 32. A booklet has instructions therein for location of every mintmark on all coins 24, which have been minted in the United States.

In use, the pages would feature two horizontal pockets. Contained within the pockets would be cardboard sheets. Each sheet would have a series of holes sized to fit different coins. The sheets would also be labeled with years and various mint locations. Thus, the user would be able to easily store, organize, and reference coins from a particular mint.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A coin collecting and storage system for holding a plurality of coins, said system comprising:

a plurality of panels, each of said panels having a front side having a left portion, a right portion and a central portion, said central portion having a plurality of sets of depressions therein, each of said sets being aligned along generally parallel lines extending from left to right, each of said sets of depressions being associated with a set of coins from one minting city, each of said sets of coins generally including a penny, a nickel, a dime, a quarter, a half-dollar and a dollar, each of said depressions on the panel being associated with a year of minting, wherein said depressions are not positioned in said set of depressions for coins not minted such that only a group of coins minted in one year may be stored an associated one of said panels according to minting city, each of said right portions having year indicia thereon corresponding to said year of minting, each of said left portions having city name indicia thereon aligned with a corresponding set of depressions, wherein each of said panels corresponds to a different year.

2. The coin collecting and storage system as in claim 1, further including associated minting mark and year indicia being located adjacent to each of said depressions.

3. The coin collecting and storage system as in claim 2, wherein said minting mark indicia is not indicated if the associated coin does not have a mint mark thereon.

4. The coin collecting and storage system as in claim 1, wherein said left and right portions are severed from said middle portion, additionally comprising:

a plurality of binding sheets, each of said binding, sheets being generally planar and having a generally rectangular shape with a left edge and a right edge, each of said sheets having, a plurality of apertures therein positioned generally adjacent to said left edge, a pair of sets of pockets being positioned on one side of said sheets, each of said sets including three pockets, wherein there is defined a left pocket, a right pocket and a center pocket, each of said portions of said panels being removably extendable into one of a corresponding one of said pockets.

5. A coin collecting and storage system for holding a plurality of coins, said system comprising:

a plurality of panels, each of said panels having a front side having a left portion, a right portion and a central portion, said central portion having a plurality of sets of depressions therein, each of said sets being aligned along generally parallel lines extending from left to right, each of said sets of depressions being associated with a set of U.S. coins from one minting city, each of said sets of coins generally including a penny, a nickel, a dime, a quarter, a half-dollar and a dollar, each of said depressions on the panel being associated with a year of minting, wherein said depressions are not positioned in said set of depressions for coins not minted such that only a group of coins minted in one year may be stored an associated one of said panels according to minting city, each of said depressions having year and minting mark indicia positioned adjacent thereto, wherein said minting mark indicia is not indicated if the associated coin does not have a mint mark thereon, each of said right portions having year indicia thereon corresponding to said year of minting, each of said left portions having city name indicia thereon aligned with a corresponding set of depressions, said left and right portions being severed from said middle portion, wherein each of said panels corresponds to a different year;

a plurality of binding sheets, each of said binding sheets being generally planar and having a generally rectangular shape with a left edge and a right edge, each of said sheets having a plurality of apertures therein positioned generally adjacent to said left edge, a pair of sets of pockets being positioned on one side of said sheets, each of said sets including three pockets, wherein there is defined a left pocket, a right pocket and a center pocket, each of said portions of said panels being removably extendable into one of a corresponding one of said pockets;

a binder for releasably holding a plurality of sheets; and a booklet having instructions therein for location of every mint mark on all coins, which have been minted in the United States.

* * * * *